US006754360B2

(12) United States Patent
Granziera

(10) Patent No.: US 6,754,360 B2
(45) Date of Patent: Jun. 22, 2004

(54) SIGNAL-HORN

(75) Inventor: Attilio Granziera, Camisano Vicentino (IT)

(73) Assignee: Stebel SPA, Vicentino (IT)

( * ) Notice: Subject to any disclaimer, the term of this patent is extended or adjusted under 35 U.S.C. 154(b) by 54 days.

(21) Appl. No.: 10/182,799

(22) PCT Filed: Feb. 2, 2001

(86) PCT No.: PCT/EP01/01091

§ 371 (c)(1),
(2), (4) Date: Nov. 25, 2002

(87) PCT Pub. No.: WO01/57848

PCT Pub. Date: Aug. 9, 2001

(65) Prior Publication Data

US 2003/0136328 A1 Jul. 24, 2003

(30) Foreign Application Priority Data

Feb. 4, 2000 (IT) ..... VI2000A0026

(51) Int. Cl.[7] ..... H04R 25/00

(52) U.S. Cl. ..... 381/340; 381/339; 381/341; 181/192

(58) Field of Search ..... 381/337, 338, 381/339, 340, 341, 342, 161; 181/177, 175, 192, 193, 194, 195; 340/388.1, 388.7; 116/59

(56) References Cited

U.S. PATENT DOCUMENTS 3,886,546 A * 5/1975 Ueda ..... 340/388.7
4,465,160 A * 8/1984 Kawamura et al. ..... 181/192

* cited by examiner

*Primary Examiner*—Huyen Le
(74) *Attorney, Agent, or Firm*—Dykema Gossett PLLC

(57) ABSTRACT

A signal-horn has an electromagnetically actuated oscillating membrane coupled to an acoustic amplifier having a volute wound duct formed of a first length with generally constant section having an inlet for the sound signal and a second length with variable section in the form of a conical exponential having an outlet for the sound signal. The ratio of the figure representing the volume defined by the oscillating membrane between two points of maximum elongation and the figure representing the area of the cross section of the first length is between 16 and 20.

4 Claims, 3 Drawing Sheets

SIGNAL-HORN

FIELD OF THE INVENTION

The present invention relates to an electromagnetic signal-horn particularly adapted to be used on motor vehicles or motor cycles of any kind.

BACKGROUND OF THE INVENTION

The known electromagnetic signal-horns comprise a generator of sound waves, referred to as propulsor unit, which is coupled to an acoustic amplifier generally consisting of an amplifying duct having the shape of a horn.

More particularly the propulsor unit comprises an electromagnet adapted to vibrate at a predetermined frequency a membrane free to carry out an alternative motion generating a sound wave addressed to the amplifying duct. The amplifying duct is generally wound as a volute to limit the total dimension of the horn and comprises a first length with a substantially constant section provided with an inlet for the sound signal generated by the oscillating membrane and a second length with variable section according to a substantially conical exponential rule ending with an outlet for the amplified sound signal.

In operation at each actuation of the signal-horn, the electromechanical propulsor unit causes the membrane to oscillate generating sound waves which travel through the entire amplifying duct and are emitted amplified.

More particularly the amplifying duct operates as an acoustic amplifier of selective type, with the pass band centered on the frequencies that can be better heard by the human ear.

As above mentioned said signal-horns are used on motor vehicles and are generally installed individually or as a couple inside the engine compartment. Signal-horns of different features are available on the market and are divided into three categories according to their size: small size or mini horn with diameter 80 mm, mid size diameter 90 mm and medium high size diameter 100 mm, the latter being almost exclusively installed on trucks for their cost and dimensions.

The acoustic performance as to the sound level of said horns is proportional to the dimensions both of the propulsor unit and the amplifying duct.

The need to optimize space and reduce dimensions of each component of the motor vehicle, led to reduce as much as possible the dimensions of the signal-horns, but trying to keep both the sound power and distribution of frequency within the values set by the regulations and required for the approval of the motor vehicle type.

A first drawback of the known horns is due to the fact that by reducing the dimensions of the horn, the levels of sound pressure generated by the horn are considerably reduced, and sometimes do not reach the minimum values required by the regulations especially when individually installed.

Indeed the acoustic performance of these horns are proportional, as hereinbefore mentioned, to the dimensions of both the propulsor unit and the amplifying duct.

This drawback is generally solved by installing a couple of horns however doubling both the overall dimensions of the equipment and its cost or installing single horns of bigger dimensions.

Another drawback is due to the fact that the manufacturer is obliged to impose constrains of installation of the horn in order to make up for the limited level of sound pressure.

More particularly it is necessary to install the horn in such a way that sound propagation occurs without reflections and obstacle, thus in the most exposed positions. However this predisposes the horn to possible damages due to water-sprays or projection of stones and mud.

SUMMARY OF THE INVENTION

An object of the present invention is to overcome said drawbacks.

More particularly a first object of the invention is to provide an electromechanical acoustic signal-horn that has dimensions equivalent to those of the small size signal-horns but can develop a sound power equivalent to that developed by signal-horns of bigger size.

Another object is to provide a signal-horn having a manufacturing cost lower than the horns of known type but with the same performances.

Another object of the invention is to provide a horn that can be installed without specific installation constrains.

The above mentioned objects are attained by an electromagnetic signal-horn the main features of which are according to claim one.

Advantageously the signal-horn of the invention develops an acoustic power which is almost the double in comparison with the acoustic power developed by the known horns of the same dimensions.

Still advantageously the invention allows to reduce the costs of installing the horn because there are no special constrains of installation of the horn.

The above mentioned objects and advantages will be better understood by the following detailed description of a constructional preferred embodiment of the invention given as an illustrative but non-limiting example and with reference to the accompanying sheets of drawings in which:

DETAILED DESCRIPTION OF THE PREFERRED EMBODIMENTS

Figure 1:
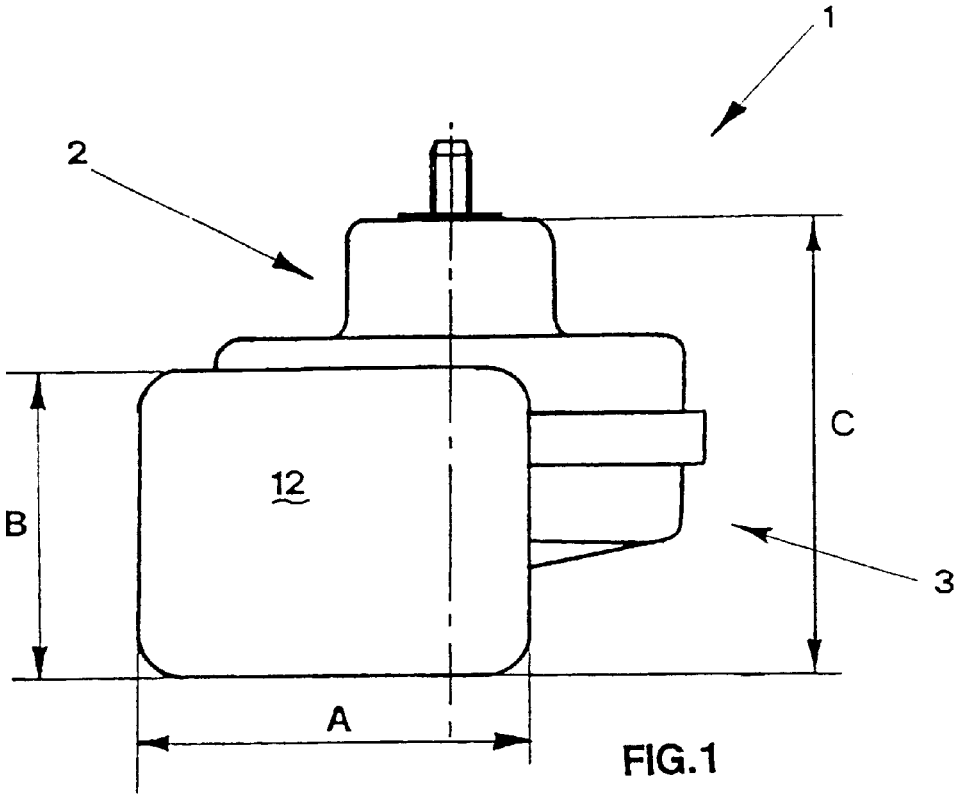
FIG. 1 is a side view of the signal-horn of the invention.
Figure 2:
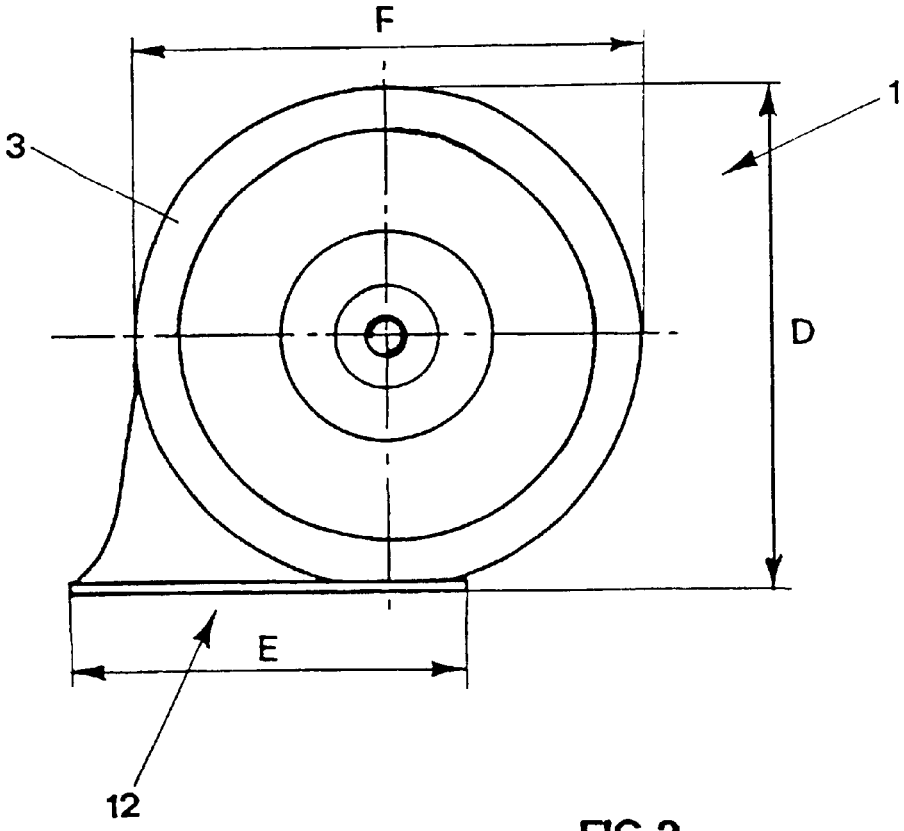
FIG. 2 is a plan view of the signal-horn of FIG. 1.

The electromagnetic signal-horn of the present invention is shown in FIGS. 1 and 2 where it is generally indicated with reference numeral 1 and comprises a generator 2 of sound waves coupled to an acoustic amplifier 3. The generator 2 of sound waves shown in detail in FIG. 3, comprises an oscillating membrane 4 actuated by an electromechanical propulsor unit 5 consisting of an electromagnet.

Figure 3:
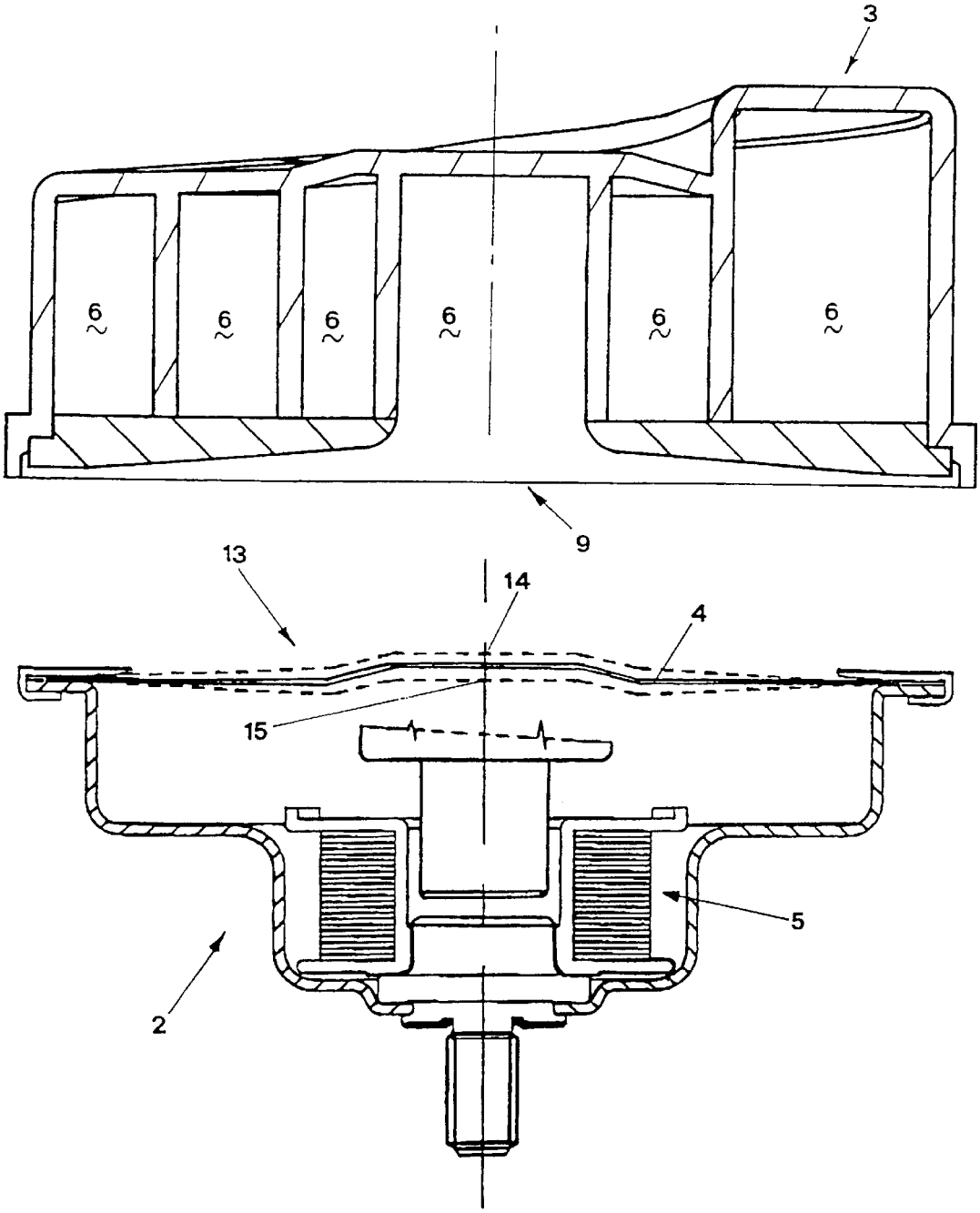
FIG. 3 is an exploded axial sectional view of the horn of FIG. 1.
Figure 4:
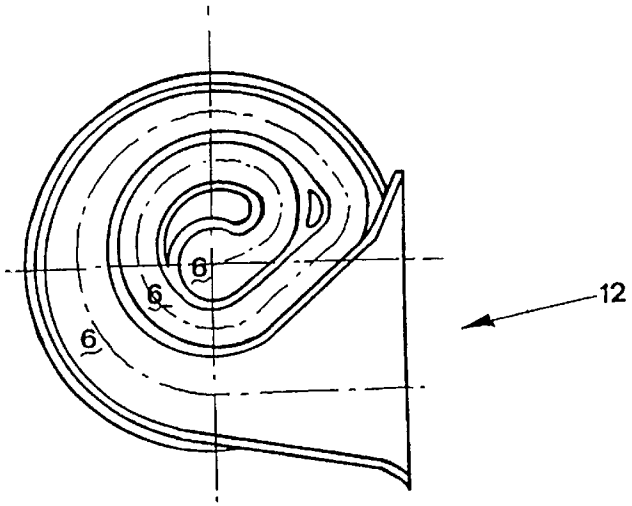
FIG. 4 is a sectional view of an element of the horn of FIG. 1.
Figure 5:
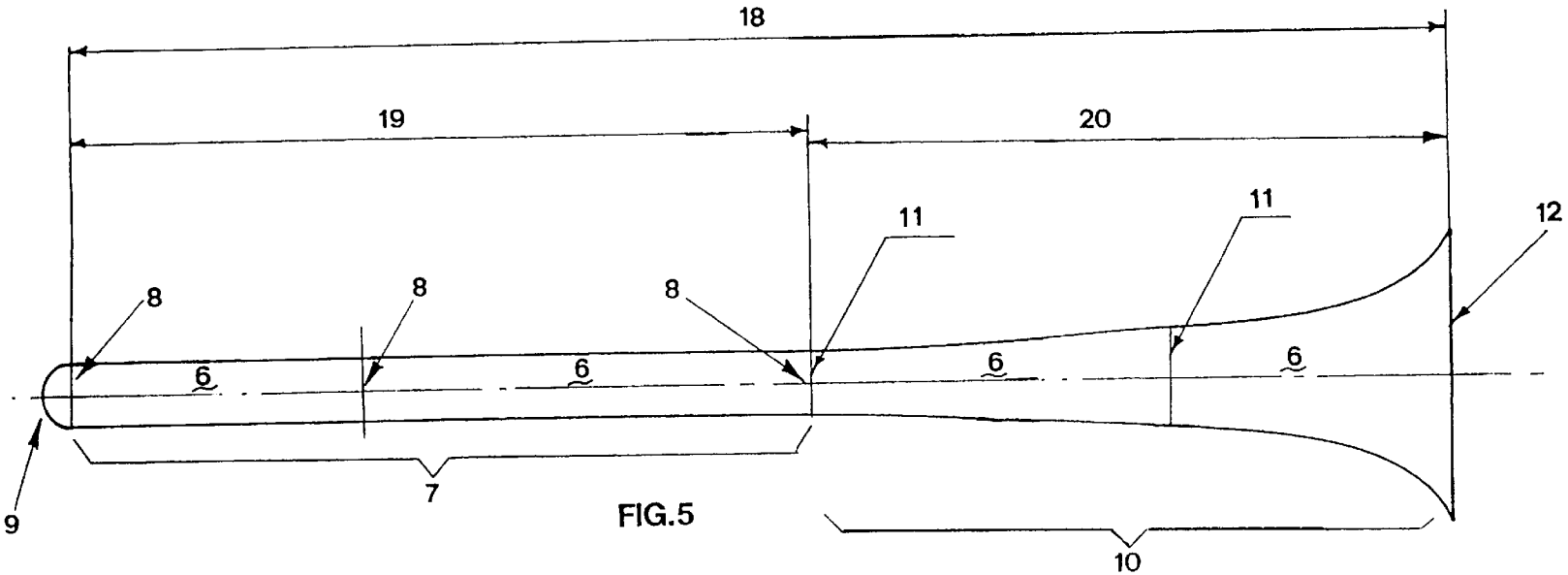
FIG. 5 is the development of the element of FIG. 4 in the plane of the longitudinal section of the acoustic amplifier.

The acoustic amplifier 3 consists of a duct 6 that can be seen in detail in FIGS. 3, 4 and 5, wound as a volute in which one can see a first length 7 with a generally constant section 8 provided with an inlet 9 for the sound signal to be amplified and a second length 10 with a section 11 variable according to a conical exponential rule, ending with an outlet 12 for the amplified sound signal.

The invention provides that the ratio between the figure representing the volume 1, indicated in $mm^3$ defined by the variation of position of the oscillating membrane 4 shown in FIG. 3, between the two points of maximum elongation, indicated with 14 and 15 respectively, and the figure representing the area of a cross section 8 of the first length 7 indicated in $mm^2$, is a number comprised between 16 and 20, when each quantity is indicated with homogeneous measuring units and preferably is equal to 18.

More particularly an increase of the level of sound pressure at parity of dimensions was observed, in the order of 3 decibel (dB) that it is equivalent to doubling the acoustic power heard by the human ear.

Such an increase of power puts the horn of category diameter Ø80 mm made according to the invention, among the known horns of higher category as it is possible to see in the following table.

More particularly some typical values are shown of the dimensions A, B, C, D, E, F (see the reference in FIGS. 1 and 2) and of the sound power of known models (diameters Ø90 and Ø100 mm) and of the invention (diameter Ø80 mm).

TABLE 1

| CATEGORY | A | B | C | D | E | F | WEIGHT | VIBRATING MEMBRANE DIAMETER | SOUND POWER AT 13 V dB (A) |
|---|---|---|---|---|---|---|---|---|---|
| Ø80 | 68 | 52 | 70 | 83 | 91 | 83 | 230 | 68 | 111 |
| Ø90 | 75 | 60 | 77 | 97 | 107 | 95 | 320 | 84 | 110 |
| Ø100 | 84 | 62 | 98 | 110 | 120 | 106 | 420 | 92 | 113 |

As one can see by comparing the details, the horn with diameter Ø80 mm made according to the invention develops a power of 111 dB, higher that the power developed by a horn diameter Ø90 mm of traditional kind and lower than a conventional horn with size Ø100 mm.

Again according to the invention the ratio between area of the surface of the outlet 12 and the area of a cross section 8 of the first length 7 both quantities indicate in $mm^2$ is comprised between 16 and 20, and preferably is equal to 18.

According to the invention the product a×b×c is comprised between 60 and 75 wherein:

a) is the distance 18 to be seen in FIG. 5, between the inlet 9 and outlet 12; indicated in millimeters;

b) is the area of a cross section 8 of the first length 7 indicated in square millimeters;

c) is the inverse of the wave length of the fundamental frequency of the sound signal indicated in millimeters.

As to the ratio of the distance 18 between inlet 9 and outlet 12 and the length 19 of the first length 7, this is comprised between 1.8 and 2.2 and preferably is 2 when each quantity is indicated with homogeneous measuring units.

It is to be noted that the cross section of each length of the whole duct is substantially polygonal but constructional variations may provide for circular cross sections having an area equivalent to the duct with polygonal section. It is also to be noted that the above mentioned rules are applicable also to ducts of such a kind and the sound signal has a fundamental frequency comprised between 380 hertz and 530 hertz.

What is claimed is:

1. An electromagnetic signal-horn comprising:

a generator of sound waves having an oscillating membrane actuated by an electromechanical propulsor unit coupled to an acoustic amplifier including a duct wound as a volute in which there is at least a first length with substantially constant section, provided with an inlet for the sound signal to be amplified and at least a second length with a variable section according to a generally conical exponential rule ending with an outlet for the amplified sound signal, wherein the ratio of a figure representing the volume indicated in $mm^3$, defined by said oscillating membrane between two points of maximum elongation and a figure representing the area of a cross section of said first length, indicated in $mm^2$, is a number between 16 and 20;

the ratio of the surface area defined by said outlet and the area of a cross section of said first length is between 16 and 20, said areas being indicated in $mm^2$;

the product of the distance between said inlet and said outlet indicated in millimeters by the area of a cross section of said first length indicated in square millimeters; and by the inverse of the wave length of the fundamental frequency of said sound wave indicated in millimeters, is between 60 and 75.

2. The horn according to claim 1 wherein at least one of said ratios is equal to 18.

3. The horn according to claim 1 wherein said ratios are both equal to 18.

4. The horn according to claim 1 wherein said sound signal has fundamental frequencies between 380 hertz and 530 hertz.

* * * * *